US008403460B2

(12) United States Patent
Duby et al.

(10) Patent No.: US 8,403,460 B2
(45) Date of Patent: Mar. 26, 2013

(54) PRINTHEAD MODULE

(75) Inventors: Thomas G. Duby, Enfield, NH (US); Robert L. Wells, Jr., Thetford Center, VT (US); Todd Severance, Newbury, NH (US); Carl Tracy, Norwich, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 898 days.

(21) Appl. No.: 11/741,325

(22) Filed: Apr. 27, 2007

(65) Prior Publication Data

US 2007/0252874 A1 Nov. 1, 2007

(51) Int. Cl.
*B41J 2/05* (2006.01)
*B41J 2/045* (2006.01)

(52) U.S. Cl. ..... 347/67; 347/68

(58) Field of Classification Search ..... 347/67, 347/85, 68–72
See application file for complete search history.

(56) References Cited

U.S. PATENT DOCUMENTS

| | | | | |
|---|---|---|---|---|
| 5,512,793 | A | 4/1996 | Takeuchi et al. | |
| 6,070,965 | A * | 6/2000 | Fujimoto | 347/50 |
| 6,089,698 | A | 7/2000 | Temple et al. | |
| 6,260,951 | B1 | 7/2001 | Harvey et al. | |
| 6,322,200 | B1 | 11/2001 | Feinn et al. | |
| 2002/0051039 | A1 | 5/2002 | Moynihan et al. | |
| 2003/0215335 | A1 | 11/2003 | Crivelli | |
| 2004/0107902 | A1 | 6/2004 | Jiang et al. | |
| 2005/0179735 | A1 | 8/2005 | Keenan et al. | |

FOREIGN PATENT DOCUMENTS

| | | |
|---|---|---|
| EP | 0 666 605 | 8/1995 |
| EP | 1 559 556 | 8/2005 |
| JP | 11-216861 A | 8/1999 |
| JP | 11-238920 | 8/1999 |
| JP | 200574966 | 3/2005 |
| JP | 2005-238720 | 9/2005 |
| JP | 2006-62373 A | 3/2006 |
| WO | WO 93/15911 | 8/1993 |
| WO | WO 99/10179 | 3/1999 |

OTHER PUBLICATIONS

U.S. Appl. No. 60/796,154, filed Apr. 28, 2006, Duby, et al.
Search Report dated Dec. 28, 2009 in co-pending European application No. 07761353.7.
Communication pursuant to Article 94(3) EPC in European Application No. 07761353.7 mailed May 6, 2010, 7 pages.
Office action from Chinese Application No. 200780015481.1 dated Aug. 30, 2011.
International Preliminary Report on Patentability from international application No. PCT/US2007/067506 dated Nov. 6, 2008, 6 pgs.
International Search Report and Written Opinion from international application No. PCT/US2007/067506 dated Feb. 12, 2008, 9 pgs.
Office action from Chinese Application No. 201010126149.6 dated Apr. 13, 2011.

(Continued)

*Primary Examiner* — Geoffrey Mruk
(74) *Attorney, Agent, or Firm* — Fish & Richardson P.C.

(57) ABSTRACT

A printhead including a body; an actuator attached to the body, and an enclosed space between the actuator and the body forms a chamber; an opening defined by the body for releasing pressure in the chamber; and a seal attached to the opening to seal the chamber while permitting pressure to be released.

17 Claims, 6 Drawing Sheets

OTHER PUBLICATIONS

Office action from Japanese Application No. 2009-507954 dated Jul. 19, 2011.
Office action dated Jan. 13, 2011 issued in corresponding Chinese application No. 201010126147.7, 5 pgs.
Office action dated Aug. 4, 2011 issued in Chinese application No. 201010126147.7, 5 pgs.
Office action dated Feb. 23, 2012 issued in Chinese application No. 201010126149.6, 5 pgs.
Office action issued Mar. 5, 2012 in Chinese application No. 201010126147.7, 8 pgs.
Office Action dated Mar. 21, 2012 for Japanese Application No. 2011-254023 and its English translation. 7 pages.
Office Action for Japanese Application No. 2011-254022, dated Jul. 3, 2012 and its English translation, 8 pages.
Office action from Chinese Application No. 200780015481.1 dated May 29, 2012, 4 pages.
Office action dated Oct. 10, 2012 issued in Chinese application No. 201010126147.7 (8 pgs.).

* cited by examiner

PRINTHEAD MODULE

BACKGROUND

Droplet ejection devices are used for depositing droplets on a substrate. Ink jet printers are a type of droplet ejection device. Ink jet printers typically include an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead has an array of ink paths with corresponding nozzle openings and associated actuators, such that drop ejection from each nozzle opening can be independently controlled. In a drop-on-demand printhead, each actuator is fired to selectively eject a drop at a specific pixel location of an image as the printhead and a printing substrate are moved relative to one another. In high performance printheads, the nozzle openings typically have a diameter of 50 microns or less, e.g. around 35 microns, are separated at a pitch of 100-300 nozzle/inch, have a resolution of 100 to 3000 dpi or more, and provide drop sizes of about 1 to 70 picoliters or less. Drop ejection frequency can be 10 kHz or more.

Printing accuracy is influenced by a number of factors, including the size and velocity uniformity of drops ejected by the nozzles in the head and among multiple heads in a printer. The drop size and drop velocity uniformity are in turn influenced by factors such as the dimensional uniformity of the ink paths, acoustic interference effects, contamination in the ink flow paths, and the actuation uniformity of the actuators.

SUMMARY

In general, in an aspect, a printhead includes a body; an actuator attached to the body, and an enclosed space between the actuator and the body forms a chamber; an opening defined by the body for releasing pressure in the chamber; and a seal attached to the opening to seal the chamber while permitting pressure to be released.

Implementation can include one or more of the following features. The actuator can include a piezoelectric material, and the seal can be made of plastic (e.g., polyimide). The printhead can include a laminate subassembly, the actuator can be attached to the laminate subassembly, and the laminate subassembly can include a flex print, cavity plate, descender plate, acoustic dampener, spacer, and an orifice plate. Openings can be formed in the acoustic dampener, and channels can be formed in the descender plate. The printhead can include an ink manifold defined by the body. The seal can be attached to the opening using a detachable adhesive.

In another aspect, a flexible circuit includes a body made of a flexible material, electrical traces formed on the body, and openings defined by the body for fluid to pass through.

Implementations can include one or more of the following features. The body can be made of a polyimide, or can include two layers of a flexible material (e.g., polyimide) that are bonded together (e.g., with an adhesive that can include polyimide). The body can include a base layer (e.g., polyimide material), the electrical traces being formed on the base layer, and a coverlay (e.g., printable polyimide) covering the electrical traces.

In yet another aspect, a laminate subassembly includes a plurality of laminates, including an actuator, cavity plate, descender plate, and orifice plate, each laminate having openings, the openings in each laminate align with the openings in the other laminates, and inspection of the openings ensures alignment and placement of the laminates.

Implementations can include one or more of the following features. The laminate subassembly can further include a fiducial mark on the actuator, such that the fiducial mark is visible when the laminates are aligned. The plurality of laminates can also include an acoustic dampener, flexible circuit, and a spacer.

In an aspect, a method of aligning laminates includes providing a plurality of laminates with openings, including an actuator, cavity plate, descender plate, and orifice plate, one of the laminates includes a fiducial mark; aligning the laminates using the openings in the laminates and the fiducial mark on one of the laminates; attaching the laminates together; and inspecting the openings to determine alignment of the laminates. Inspecting the openings can include using a camera to look through the openings in the laminates to verify that the fiducial mark is aligned with the openings.

Further aspects, features, and advantages will become apparent from the following detailed description, the drawings, and the claims.

DETAILED DESCRIPTION

Figure 1A:
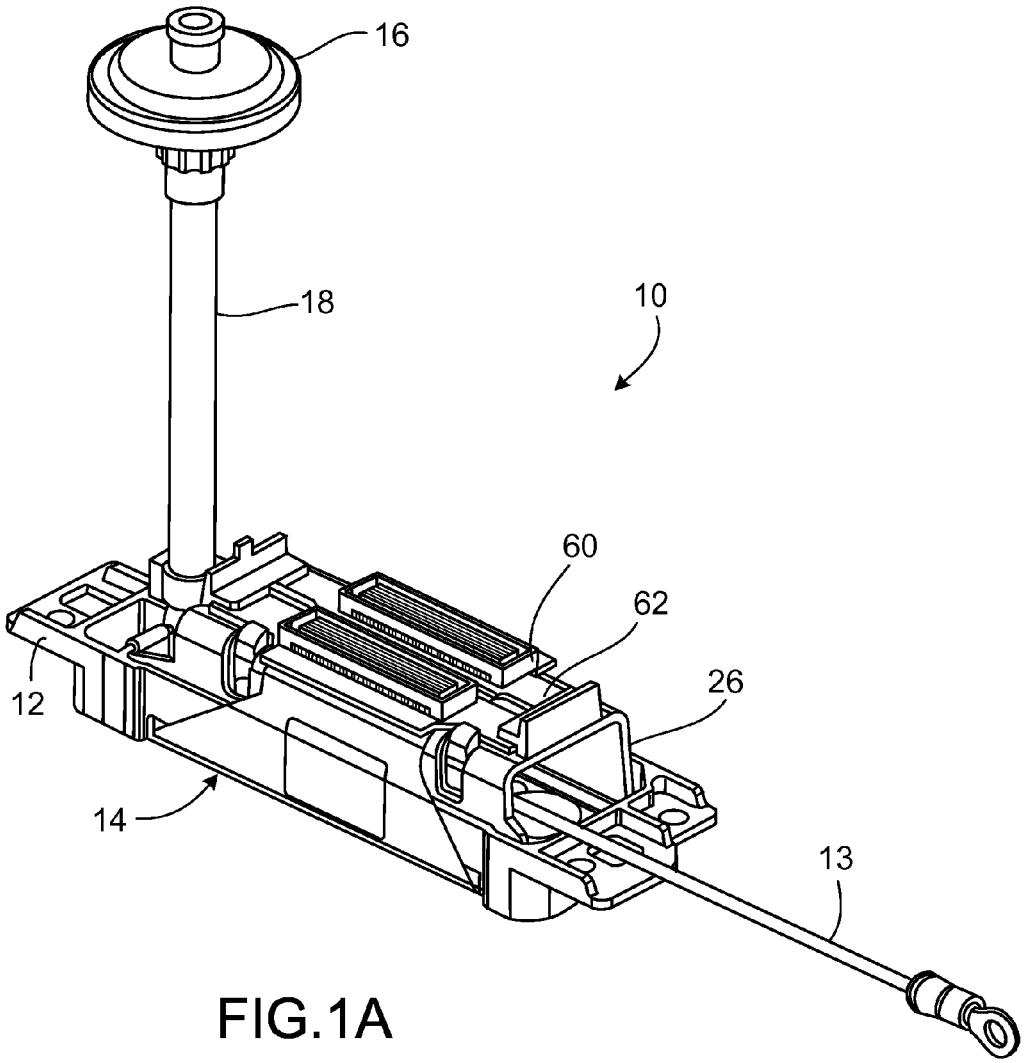
FIG. 1A is a perspective view of a printhead.
Figure 1B:
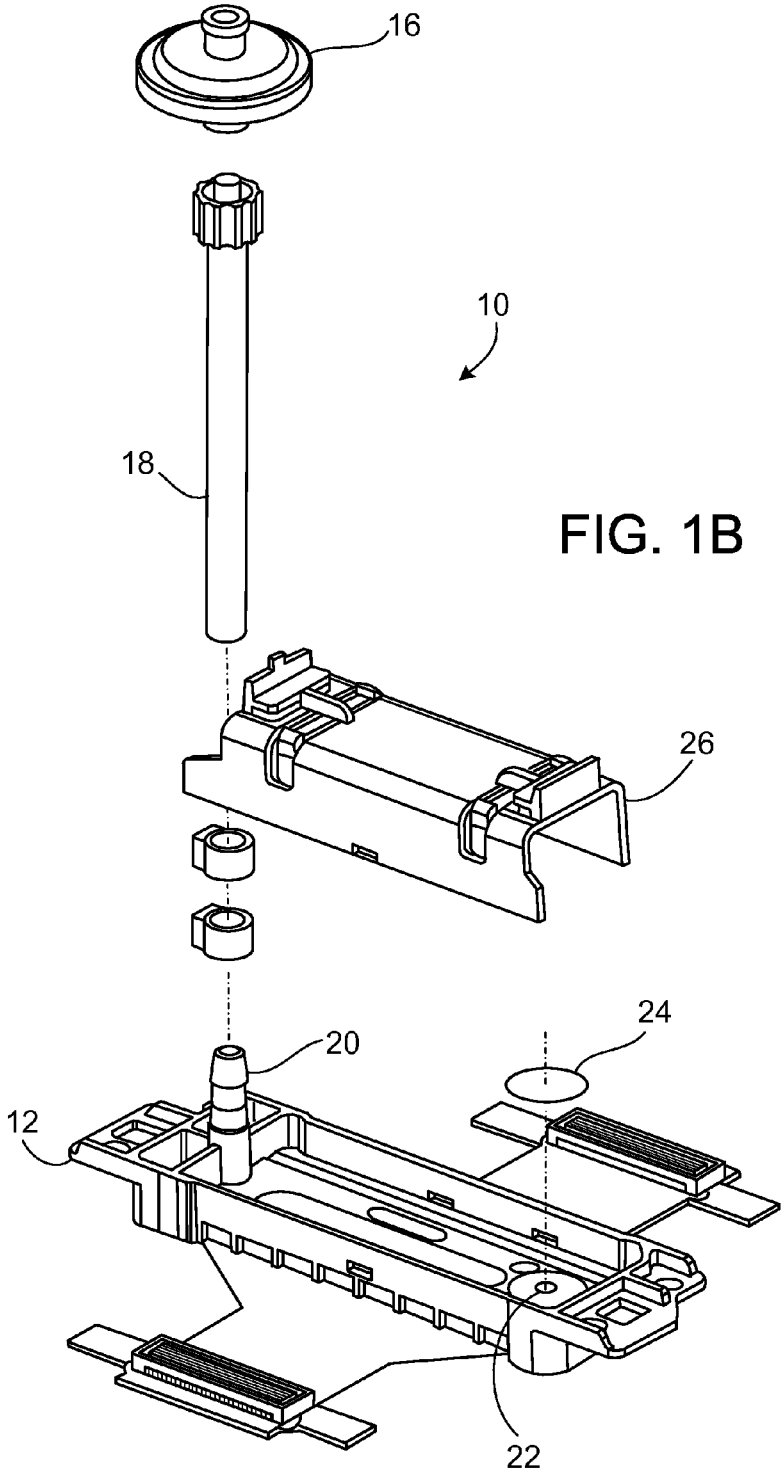
FIG. 1B is an exploded view of a printhead.

Referring to FIGS. 1A and 1B, a printhead 10 includes a body 12 bonded to a laminate subassembly 14. The parts can be bonded together with an adhesive, such as an epoxy. Ink is first introduced to the printhead 10 through the filter 16 and tube 18 and into the body 12 via an ink barb 20 formed in the body 12. An opening 22 is formed in the body 12 to release air pressure between the body 12 and subassembly 14; a seal 24 is placed over the opening 22. A cover 26 is attached to the top of the body 12.

Figure 2A:
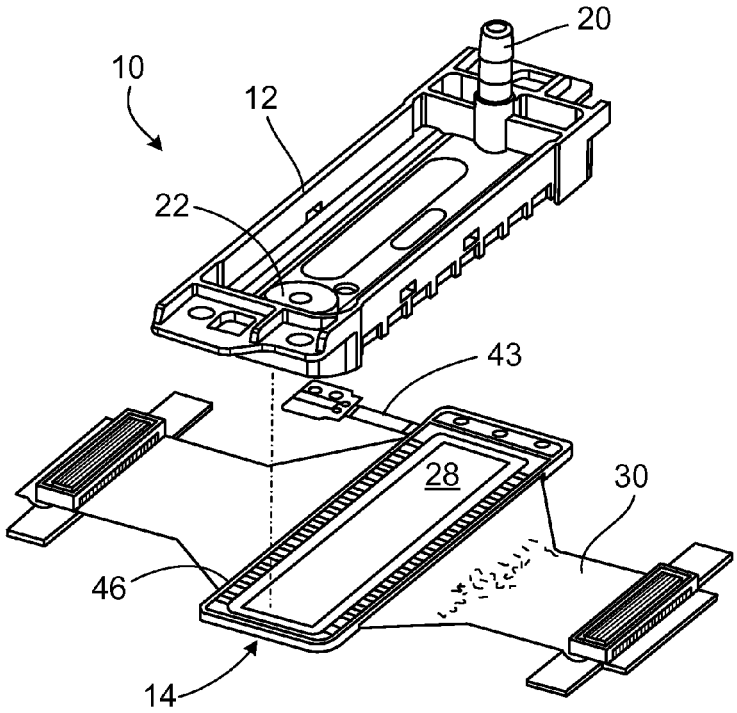
FIG. 2A is a perspective view of a body and laminate subassembly of a printhead.
Figure 2B:
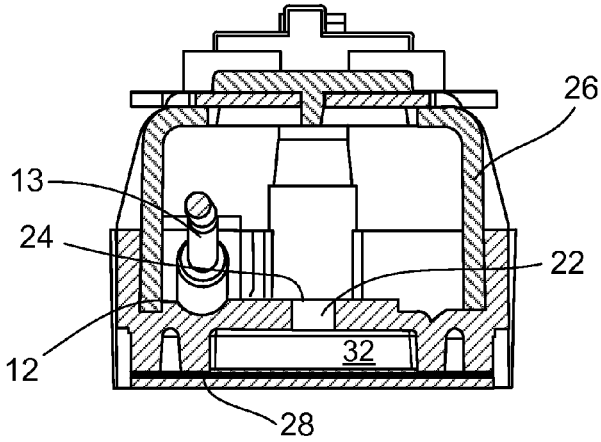
FIG. 2B is a cross-sectional view of the printhead.

FIGS. 2A and 2B show the body 12 and the subassembly 14 of the printhead 10. The first layer in the subassembly 14 is a piezoelectric element 28, which is bonded to a flex print 30. When the body 12 is bonded to the subassembly 14, a chamber 32 is formed to protect the piezoelectric element 28 from the environment and to seal it from the ink flow path.

Figure 3:
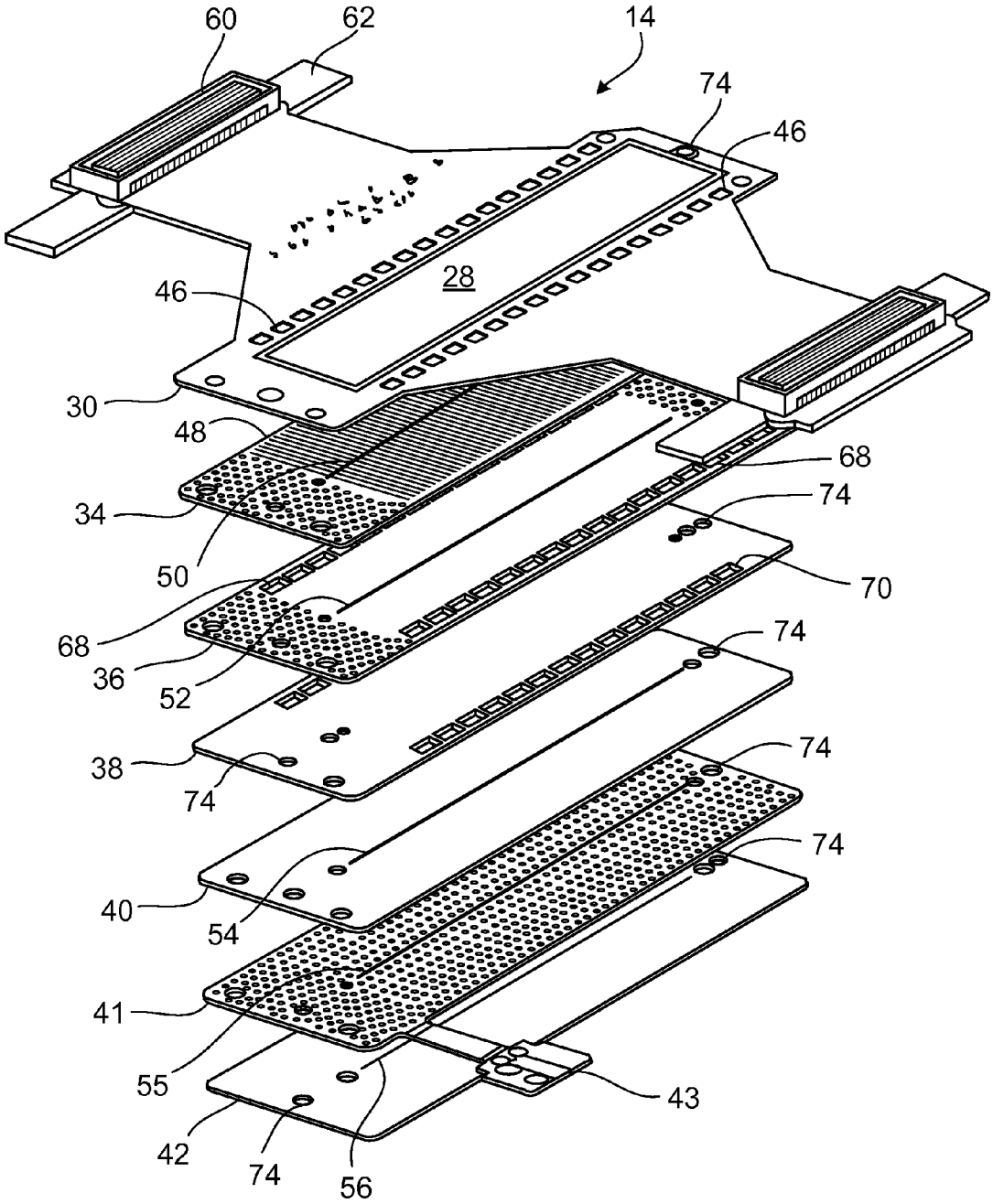
FIG. 3 is an exploded view of the laminate subassembly.

Referring to FIG. 3, the subassembly 14 includes the following parts bonded together, a piezoelectric element 28, a flex print 30, cavity plate 34, descender plate 36, acoustic dampener 38, spacer 40, and orifice plate 42. The parts can be bonded together with an adhesive, such as an epoxy.

Figure 2C:
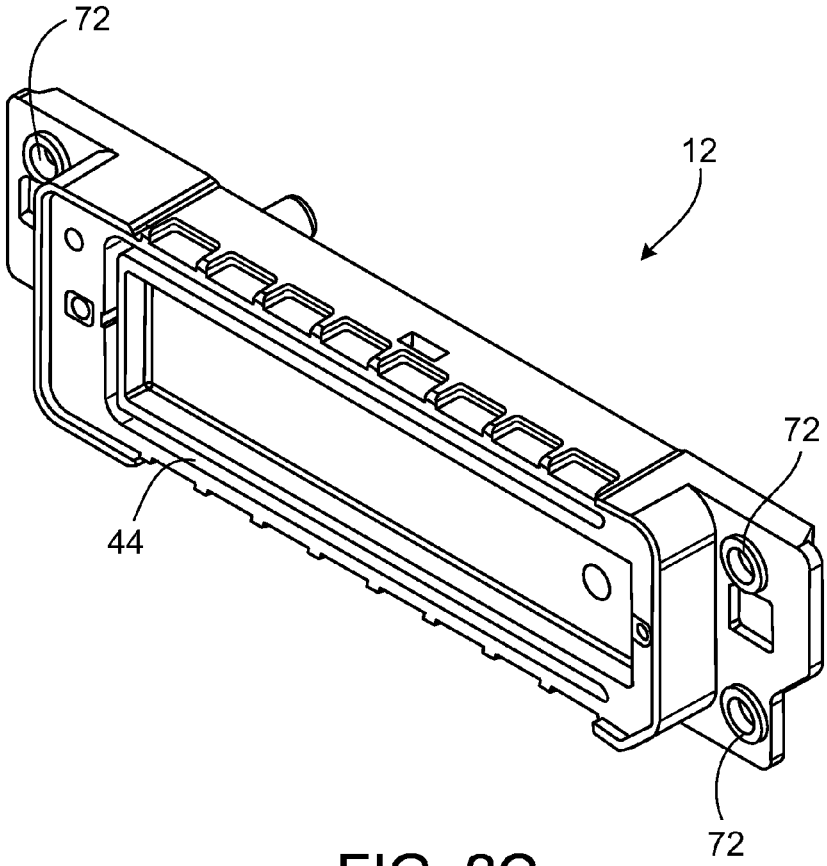
FIG. 2C is a perspective view of the bottom side of the body.

Referring to FIG. 2A, the ink travels down the ink barb 20 to the bottom side of the body 12 and into a fluid manifold 44 formed in the body 12 as shown in FIG. 2C. The ink fills the fluid manifold 44 and then travels through openings 46 in the flex print 30 and into the pumping chambers 48 formed in the cavity plate 34 as shown in FIG. 3.

Referring to FIG. 3, when the piezoelectric element 28 is actuated, the ink in the pumping chambers is pumped through openings 50 in the pumping chambers through openings 52 in the descender plate 36 through openings (not shown) in the acoustic dampener 38 through the spacer openings 54 and out the orifices 56 in the orifice plate 42.

FIG. 2B shows a cross-sectional view of the chamber 32 formed when the body 12 is bonded to the subassembly 14 with the piezoelectric element 28 as the first layer in the subassembly 14. The chamber 32 protects the piezoelectric element 28 from the external environment. An opening 22 is formed in the body 12 to release air pressure in the chamber 32, and a seal 24 is bonded to the opening 22 with adhesive (i.e., epoxy). The seal 24 can be made of a compliant material (i.e., polyimide) that changes shape under pressure.

When the air pressure inside the chamber 32 rises, a force is applied around the perimeter of the opening 22, where the seal 24 contacts the opening 22. The amount of force applied to the seal 24 is a function of the radius of the opening 22. At a certain pressure, the adhesive that bonds the seal 24 to the opening 22 can detach from the surface of the opening 22 to release air pressure, and subsequently reattach. The radius of the opening 22 and strength of the adhesive can be designed for specified air pressures, such that the adhesive detaches and reattaches at specified air pressures.

FIG. 2A shows the opening 22 in the body 12 raised above the surface of the body 12. By raising the opening 22, the piezoelectric element 28 is protected from ink leaks, and the seal 24 further protects the piezoelectric element 28 from ink or other environmental factors.

Figure 4A:
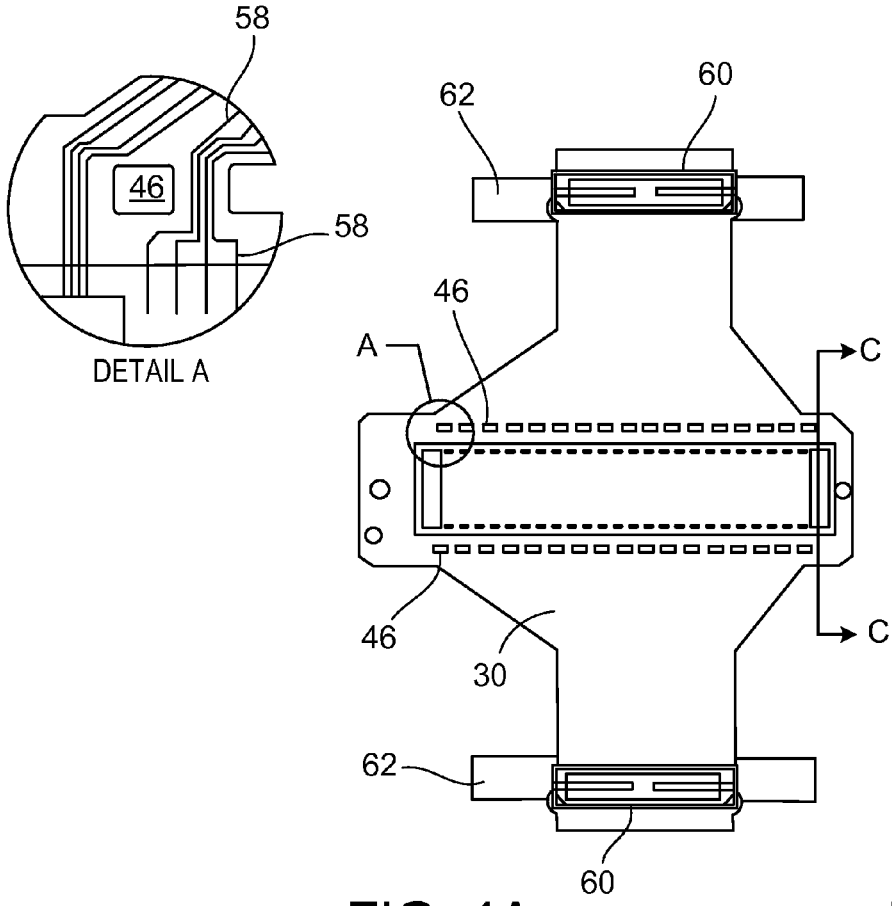
FIG. 4A is a perspective view of the flex print.

Referring to FIG. 3, the openings in the flex print 30 provide an ink flow path from the manifold 44 to the pumping chambers. FIG. 4A shows a flex print 30 with electrical traces 58 running through the spaces between the openings to avoid contact with the fluid as it travels through the openings 46. The electrical traces 58 run from electrodes near the center of the flex print 30 (next to the piezoelectric element) to the connectors 60 at the ends of the flex print 30. Tabs 62 extend on either side of the connectors 60, which snap into the cover 26 as shown in FIG. 1A.

Figure 4B:
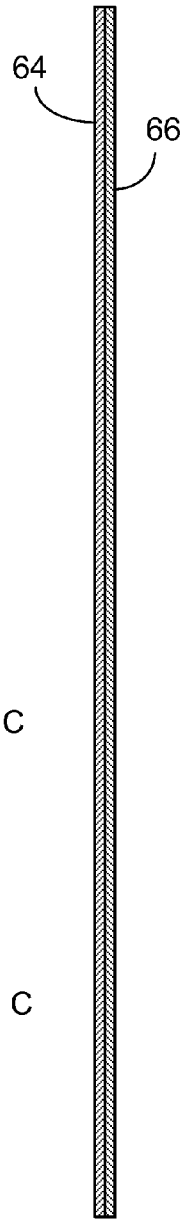
FIG. 4B is a cross-sectional view of the flex print.

FIG. 4B shows a flex print 30 with a first layer 64 and second layer 66 bonded together with an adhesive. Over time ink can separate the adhesive from the two layers and leak inside the flex print 30 and contact the electrical traces 58. In an implementation, the two layers of the flex print 30 are made of a polyimide and the adhesive also contains polyimide. The ink is less likely to separate the adhesive from the two layers when the layers of the flex print 30 and adhesive are made of the same material. The openings in the flex print 30 can be cut with a die, laser, or other similar methods. Coatings or other materials can be used to protect the edges of the openings in the flex print 30 from degradation by fluids passing through them.

Referring to FIG. 3, while the openings in the flex print 30 provide an ink flow path to the pumping chambers, only some of the openings actually line up with the pumping chambers in the cavity plate 34. The remaining pumping chambers are blocked by the spaces between the openings. For ink to reach the blocked pumping chambers, the ink travels through the openings in the flex print 30 through the unblocked pumping chambers and into channels 68 in the descender plate 36. The ink in these channels 68 then travels back up into the cavity plate 34 into the blocked pumping chambers.

Referring to FIG. 3, if the acoustic dampener 38 is made of a plastic material, such as Upilex® polyimide, the material may not bond evenly, which could leave an area of the material unbonded. For a better bond, openings 70 can be cut out of the acoustic dampener 38.

The body 12 can be made of a plastic material, such as polyphenylene sulfide (PPS), or metal, such as aluminum. The cover 26 can be made of metal or a plastic material, such as Delrin® acetal. The flex print 30 and acoustic dampener 38 can be made of Upilex® polyimide, while the descender plate 36 and cavity plate 34 can be made of a metal, such as Kovar® metal alloy. The spacer 40 can be made of material with a low modulus, such as carbon (about 7 MPa) or polyimide (about 3 MPa). The orifice plate 42 can be made of stainless steel.

The spacer 40 can be used to bond the orifice plate 42 and acoustic dampener 38 within the laminate subassembly 14. Rather than directly apply adhesive to the orifice plate 42 or acoustic dampener 38, adhesive can be directly applied on both sides of the spacer and the orifice plate 42 and acoustic dampener 38 can then be bonded to the spacer. The spacer can also distribute the strain between laminates with different thermal coefficients of expansion. For example, laminates with different thermal coefficients of expansion bonded together at a bonding temperature of about 150° C. can bow as the laminates cool to room temperature (about 22° C.). The spacer can reduce bowing in the laminate subassembly by distributing the bond strain. The thickness of the spacer and its modulus can affect its ability to distribute strain within the subassembly. The percent strain of the spacer is a function of the strain divided by the thickness of the spacer. FIG. 2C depicts the body 12 with three holes 72, two on one side of the body 12 and one on the other side, for receiving three eccentric screws to secure the printhead 10 to a rack assembly.

Referring to FIG. 3, openings 74 on the ends of each part are used to check for missing parts and alignment of the parts. An inspection camera looks into the openings 74 to visually inspect the alignment of the parts. A fiducial mark is placed on the piezoelectric element 28 and can be seen when all the parts are properly aligned. Additionally, after production or during maintenance of a printhead 10, a visual inspection through the openings 74 ensures that all the parts are present and that the parts are in the correct order.

In other implementations, the body and laminate subassembly can be attached by other securing devices, such as adhesives, screws, and clasps. The parts of the subassembly can be secured by other materials or adhesives. The seal 24 can be attached to the opening in the body by other adhesives. Referring to FIGS. 2A and 2B, rather than forming a chamber between the subassembly and the body to protect the piezoelectric element, the piezoelectric element could be protected by a coating. While FIG. 1A shows the tabs 62 snapping into the cover 26 of the printhead 10, the tabs could be secured to a printhead by screws, clasps, adhesive, or other fasteners. The flex print 30 in FIG. 3 shows several openings on both sides of the flex print 30, however, the flex print 30 can have only one opening for an ink passage or openings on just one side. Similarly, the cavity plate in FIG. 3 shows several pumping chambers on both sides of the cavity plate, but the cavity plate can have only one pumping chamber or pumping chambers on only one side.

The connectors 60 in FIG. 1A can be directly secured to the cover 26 without using the tabs 62. For example, the connectors 60 could be glued to the cover 26 using an adhesive.

Referring to FIG. 4A, the electrical traces 58 on flex print 30 can be sealed to prevent fluid flowing through openings 46 from contacting the traces. For example, a first layer 64 in FIG. 4B can be a polyimide material (i.e., Upilex® polyimide), the electrical traces can be formed on the first layer 64, and a second layer 66 can be a coverlay that covers the electrical traces. The coverlay can be a printable polyimide, such as Espanex® SPI screen printable polyimide coverlay available from Nippon Steel Chemical, Japan. The polyimide can be deposited using a silk screen printing method or other deposition methods.

Referring to FIG. 1A, the dimensions of the printhead 10 can include a height of about 29.15 mm, a length of about 115.9 mm, and a width of about 30.6 mm. Referring to FIG. 3, the laminate subassembly 14 can also include a ground plate 41 that can include a tab 43. When the laminates are stacked together, the tab 43 extends from the subassembly 14 as seen in FIG. 2A and can be folded over the housing 12. The ground wire 13 in FIG. 1 connects to the tab 43 of ground plate 41.

Referring to FIG. 3, the laminate subassembly 14 can also include a ground plate 41 that can include a tab 43. When the laminates are stacked together, the tab 43 extends from the subassembly 14 as seen in FIG. 2A and can be folded over the housing 12. The ground wire 13 in FIG. 1 connects to the tab 43 of ground plate 41.

Referring again to FIG. 3, the fluid flowing through the laminate subassembly 14 can pass through openings 54 in the ground plate 41 and out the orifices 56 in the orifice plate 42. The ground plate 41 can also have openings 74 that align with the openings 74 of the other laminates in subassembly 14.

Other implementations are within the scope of the following claims.

What is claimed is:

1. A printhead comprising:

a laminate subassembly including an actuator, a cavity plate having a pumping chamber, and an orifice plate having an orifice through which fluid is ejected, the actuator being bonded to the cavity plate such that the pumping chamber is covered by the actuator, and the cavity plate being bonded to the orifice plate such that the pumping chamber and the orifice form a flow path;

a body attached to the laminate subassembly such that the actuator is between the body and the cavity plate, the body including a fluid manifold that is part of the flow path;

an enclosed space between the body and the actuator forming a chamber that seals the actuator from the flow path;

an opening formed in a surface of the body and connected to the chamber; and a seal attached to the opening and configured to detach from the opening to release pressure and to reattach.

2. The printhead of claim 1, wherein the actuator includes a piezoelectric material.

3. The printhead of claim 1, wherein the seal comprises a compliant material.

4. The printhead of claim 3, wherein the seal comprises polyimide.

5. The printhead of claim 1, wherein the cavity plate comprises a plurality of pumping chambers.

6. The printhead of claim 5, wherein the body includes an ink manifold.

7. The printhead of claim 6, wherein the laminate subassembly includes a flexible circuit positioned between the ink manifold in the body and the plurality of pumping chambers formed in the cavity plate, the flexible circuit comprising a plurality of openings providing flow paths from the ink manifold to the plurality of pumping chambers.

8. The printhead of claim 7, wherein the flexible circuit comprises a plurality of electrical traces positioned in spaces between the plurality of openings in the flexible circuit.

9. The printhead of claim 7, wherein the flexible circuit comprises a plurality of electrical traces formed on a first layer, a second layer that covers the electrical traces, and an adhesive that bonds the first layer and second layer, wherein the first layer, second layer, and adhesive include a same material.

10. The printhead of claim 9, wherein the same material comprises a polyimide.

11. The printhead of claim 1, wherein the laminate subassembly includes a spacer configured to distribute bond strain within the laminate subassembly.

12. The printhead of claim 1, wherein the seal is attached to the opening using a detachable adhesive.

13. The printhead of claim 1, wherein the laminate subassembly further comprises a ground plate.

14. The printhead of claim 1, wherein the opening is raised relative to the surface of the body.

15. A printhead comprising:

a laminate subassembly comprising a plurality of laminates, including an actuator bearing a fiducial mark, a flexible circuit, a cavity plate including a plurality of pumping chambers, and an orifice plate, each laminate except the actuator having openings that align with openings in the other laminates when the plurality of laminates are stacked together, the openings in each laminate aligning with the fiducial mark on the actuator.

16. The printhead of claim 15, wherein the plurality of laminates further comprises a descender plate, an acoustic dampener and a spacer, all of which have openings that align with the fiducial mark and with the openings in the other laminates.

17. The printhead of claim 15, where the laminate subassembly further comprises a ground plate having openings that align with the fuducial mark and with the openings in the other laminates.

* * * * *

UNITED STATES PATENT AND TRADEMARK OFFICE

CERTIFICATE OF CORRECTION

PATENT NO. : 8,403,460 B2
APPLICATION NO. : 11/741325
DATED : March 26, 2013
INVENTOR(S) : Thomas G. Duby et al.

It is certified that error appears in the above-identified patent and that said Letters Patent is hereby corrected as shown below:

On the Title page

At Related U.S. Application Data (60) add:
--Provisional application no. 60/796,154, filed on Apr. 28, 2006--.

In the Specification

Column 1, line 2, insert the following paragraph:
--CROSS-REFERENCE TO RELATED APPLICATION
This application claims the benefit under 35 USC § 119(e) to U.S. Patent Application Serial No. 60/796,154, filed on April 28, 2006.--.

In the Claims

Column 6, line 43, delete "where" and replace with --wherein--;
line 45, delete "fuducial" and replace with --fiducial--.

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,403,460 B2
APPLICATION NO. : 11/741325
DATED : March 26, 2013
INVENTOR(S) : Duby et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1277 days.

Signed and Sealed this
Second Day of December, 2014

Michelle K. Lee

Michelle K. Lee
*Deputy Director of the United States Patent and Trademark Office*